US009051855B2

(12) United States Patent
Ito et al.

(10) Patent No.: US 9,051,855 B2
(45) Date of Patent: Jun. 9, 2015

(54) ENGINE VALVE TIMING CONTROL APPARATUS

(75) Inventors: Hironori Ito, Ebina (JP); Kenji Ariga, Fujisawa (JP); Ken Shiozawa, Yamato (JP); Takahiro Miura, Yokohama (JP); Motomu Kitamura, Ebina (JP); Naoki Osada, Sagamihara (JP); Masahiro Iriyama, Yokohama (JP); Masahiro Arai, Yokohama (JP); Hiroyuki Itoyama, Yokohama (JP); Hiroshi Abe, Isehara (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 14/232,381

(22) PCT Filed: Jul. 2, 2012

(86) PCT No.: PCT/JP2012/066846

§ 371 (c)(1),
(2), (4) Date: Jan. 13, 2014

(87) PCT Pub. No.: WO2013/021749

PCT Pub. Date: Feb. 14, 2013

(65) Prior Publication Data

US 2014/0165939 A1 Jun. 19, 2014

(30) Foreign Application Priority Data

Aug. 8, 2011 (JP) ..... 2011-172936
Feb. 23, 2012 (JP) ..... 2012-036887

(51) Int. Cl.
*F01L 1/34* (2006.01)
*F01L 1/356* (2006.01)

(Continued)

(52) U.S. Cl.
CPC . *F01L 1/34* (2013.01); *F01L 1/356* (2013.01); *F01L 13/00* (2013.01); *F02D 13/02* (2013.01);

(Continued)

(58) Field of Classification Search
CPC ..... F01L 1/34; F01L 1/356; F01L 1/3442; F02D 13/02; F02D 41/042
USPC ..... 123/90.15, 90.17, 90.31
See application file for complete search history.

(56) References Cited

U.S. PATENT DOCUMENTS 6,330,870 B1 * 12/2001 Inoue et al. ..... 123/90.17

FOREIGN PATENT DOCUMENTS

JP 2005-016445 A 1/2005
JP 2007-132272 A 5/2007

(Continued)

*Primary Examiner* — Zelalem Eshete
(74) *Attorney, Agent, or Firm* — Drinker Biddle & Reath LLP

(57) ABSTRACT

To achieve an intermediate lock state in a short period when an engine is stopped and improve the accuracy of confirmation of the intermediate lock state, an engine valve timing control apparatus includes a variable valve timing mechanism configured to vary engine valve timing, and an intermediate lock mechanism configured to restrict relative rotation positions of a first and a second rotor of the valve timing mechanism at an intermediate lock position for starting the engine. Upon detection of an engine stop request, the valve timing mechanism and the intermediate lock mechanism are driven and controlled for establishing an intermediate lock state. When a predetermined period from detection of the engine stop request has expired without detecting the intermediate lock state within the predetermined period, an engine stopping process is executed. Even after the engine stopping process has been executed, monitoring of the intermediate lock state is continued.

18 Claims, 6 Drawing Sheets

(51) Int. Cl.

| | |
|---|---|
| ***F01L 13/00*** | (2006.01) |
| ***F02D 13/02*** | (2006.01) |
| ***F01L 1/344*** | (2006.01) |
| ***F02D 41/04*** | (2006.01) |
| *F02N 19/00* | (2010.01) |
| *F02D 41/00* | (2006.01) |

(52) U.S. Cl.

CPC ..... *F01L 1/3442* (2013.01); *F01L 2001/34463* (2013.01); *F01L 2001/34466* (2013.01); *F01L 2250/04* (2013.01); *F01L 2760/001* (2013.01); *F01L 2800/01* (2013.01); *F01L 2800/03* (2013.01); *F02D 41/042* (2013.01); *F02N 19/004* (2013.01); *F02D 2041/001* (2013.01)

(56) References Cited

FOREIGN PATENT DOCUMENTS

| | | | |
|---|---|---|---|
| JP | 2009-156217 | A | 7/2009 |
| JP | 2010-265760 | A | 11/2010 |

* cited by examiner

ENGINE VALVE TIMING CONTROL APPARATUS

TECHNICAL FIELD

The present invention relates to a valve timing control apparatus for controlling valve timing of intake and/or exhaust valves of an engine (hereinafter referred to as "intake/exhaust valve"), and specifically to a technology for holding the valve timing at an intermediate lock state when the engine is stopped.

BACKGROUND ART

As an engine valve operating system, a variable valve timing mechanism capable of varying valve timing of intake and/or exhaust valves depending on an engine operating condition is generally known. For instance, as disclosed in Patent document 1, the variable valve timing mechanism has a first rotor that rotates in synchronism with rotation of a crankshaft of an engine and a second rotor that rotates together with a camshaft of the engine, the second rotor also configured to be rotatable relatively to the first rotor. Valve timing of the intake/exhaust valve, opened and closed by the camshaft, is variable by changing relative rotation positions of both of the rotors by means of an actuator.

Additionally, in the Patent document 1, also provided is an intermediate lock mechanism capable of restricting the relative rotation positions of both of the rotors (i.e., a rotation phase), corresponding to a valve timing value, at a predetermined intermediate lock position. The intermediate lock mechanism is configured to be able to restrict the relative rotation positions of both of the rotors at the predetermined intermediate lock position by bringing a lock piece attached to the one rotor into engagement with an engaged groove formed in the other rotor. For instance, when an engine stop request is detected, the relative rotation positions of both of the rotors are restricted or fixed at the intermediate lock position suited for starting the engine, and whereby it is possible to smoothly perform next engine starting.

CITATION LIST

Patent Literature

Patent document 1: Japanese patent provisional publication No. 2005-016445 (A)

SUMMARY OF INVENTION

Technical Problem

Suppose that the variable valve timing mechanism and the intermediate lock mechanism are driven and controlled closer to an intermediate lock state upon detection of an engine stop request, and then an engine stopping process such as fuel-injection stopping is executed without detecting and confirming the fact that the intermediate lock state has been established actually. There is a possibility that the engine running stops completely, even at the rotation phase still remaining out of the intermediate lock state. In the case that the engine stops at the rotation phase still remaining out of the intermediate lock state, an engine start has to be executed at valve timing unsuited for starting the engine during next engine starting.

Alternatively, it is necessary to drive the variable valve timing mechanism as well as the intermediate lock mechanism to the intermediate lock position suited for starting the engine before an engine start. This deteriorates an engine startability. In particular, in the case that each of the valve timing mechanism and the intermediate lock mechanism is a hydraulically-operated type configured to be driven by fluid pressure, it is difficult to ensure hydraulic pressure needed to drive the valve timing mechanism as well as the intermediate lock mechanism before an engine start. Thus, it is desirable to shift to the intermediate lock state before the engine is stopped.

For the reasons discussed above, when an engine stop request is detected, detecting-and-monitoring of the intermediate lock state may be carried out, and thus executing an engine stopping process after the intermediate lock state has been confirmed may be taken into account. However, assuming that, for some reason, a situation where the intermediate lock state is not yet established continues during a comparatively long time period, a time interval from the detection of the engine stop request to a point of time at which the engine stopping process is actually initiated tends to become long. This would be likely to cause the driver to feel discomfort and also to give an unfavorable impression that the responsiveness is slow on the driver. This also leads to the drawbacks that the engine running state continues unnecessarily and thus a fuel consumption performance and an exhaust emission control performance both deteriorate.

Solution to Problem

In view of the previously-described drawbacks, according to the present invention, there is provided an engine valve timing control apparatus comprising a variable valve timing mechanism having a first rotor adapted to rotate in synchronism with rotation of a crankshaft of an engine and a second rotor adapted to rotate together with a camshaft of the engine and configured to be rotatable relatively to the first rotor, the variable valve timing mechanism being configured to variably adjust valve timing of an intake/exhaust valve, opened and closed by the camshaft, by changing relative rotation positions of both of the rotors within a movable range between a maximum phase-advance position and a maximum phase-retard position, and an intermediate lock mechanism configured to restrict the relative rotation positions of both of the rotors to an intermediate lock position suited for starting the engine and positioned midway between the maximum phase-advance position and the maximum phase-retard position.

When an engine stop request is detected, the variable valve timing mechanism and the intermediate lock mechanism are driven and controlled so as to establish an intermediate lock state where the relative rotation positions are restricted at the intermediate lock position. The engine valve timing control apparatus of the invention is characterized in that detecting-and-monitoring whether the intermediate lock state has been established is carried out, and that, when a predetermined period from detection of the engine stop request has expired without detecting the intermediate lock state within the predetermined period, an engine stopping process is executed, and also characterized in that, even after the engine stopping process has been executed, monitoring of the intermediate lock state is continued.

Advantageous Effects of Invention

In this manner, according to the invention, an engine stopping process such as fuel-injection stopping is executed after an intermediate lock state has been confirmed when the time elapsed from detection of an engine stop request is within a predetermined period, without stopping the engine upon the detection of the engine stop request. Thus, it is possible to reduce a possibility that the engine is stopped before the intermediate lock state becomes established, thereby enhancing the engine startability.

Additionally, upon expiration of the predetermined period (for example, about one second) from the detection of the engine stop request, the engine stopping process is executed without waiting for the detection and confirmation of the intermediate lock state. That is, the engine can be stopped for a comparatively short time (the predetermined period) without detecting-and-confirming the fact that the intermediate lock state has been established. Hence, a long time from the detection of the engine stop request to a point of time at which the engine stopping process is actually initiated is not required, and thus it is possible to enhance the engine-stop responsiveness.

Furthermore, even after the engine has been stopped, monitoring of the intermediate lock state is continued. Therefore, it is possible to detect-and-confirm the intermediate lock state, even in the case that the intermediate lock state becomes established with the engine crankshaft rotating by inertia for instance after the engine stopping process has been initiated without detecting-and-confirming the intermediate lock state. Hence, it is possible to more greatly improve the detection accuracy of the intermediate lock state when the engine is stopped.

DESCRIPTION OF EMBODIMENTS

Figure 1:
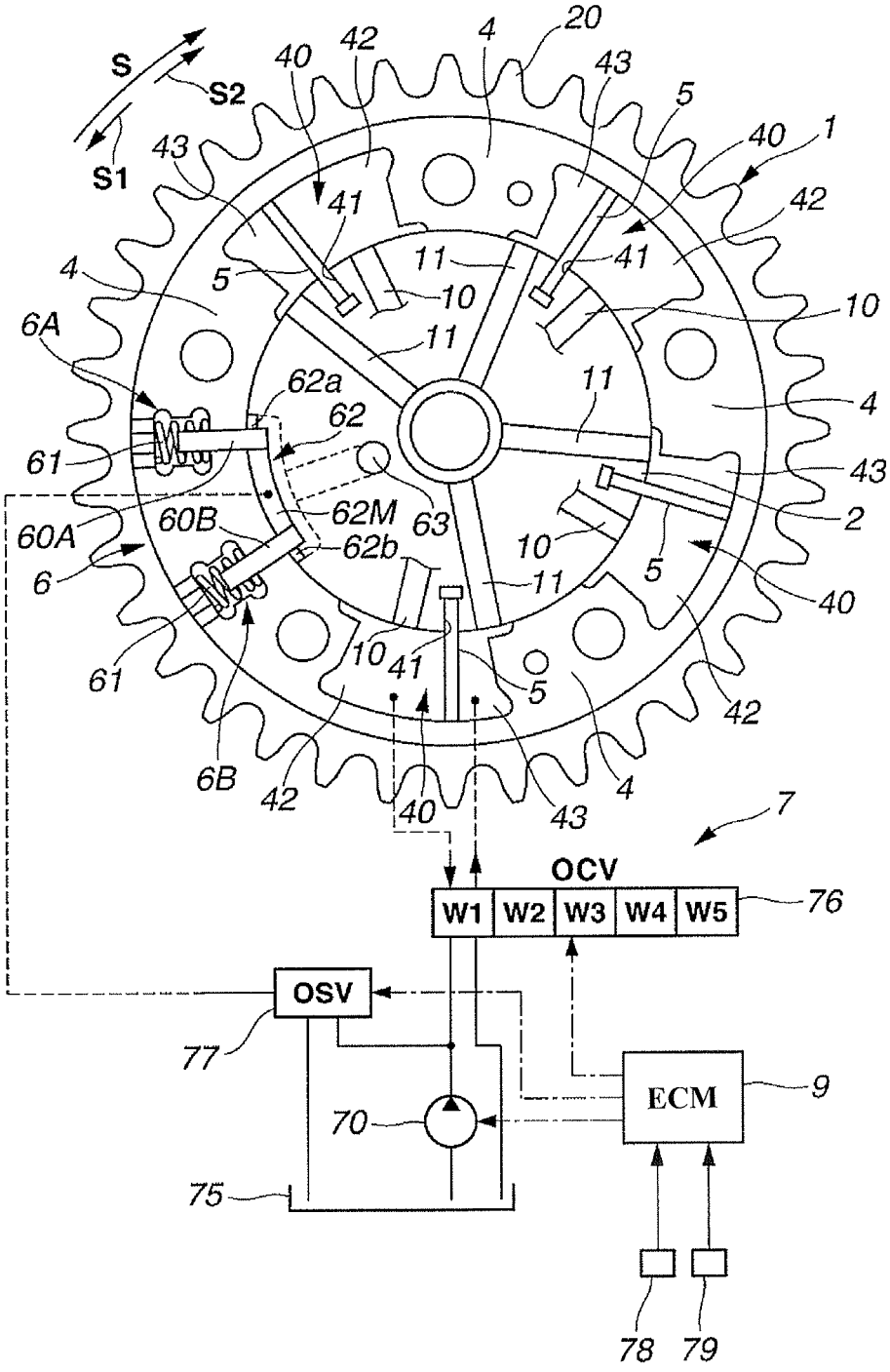
FIG. 1 is a cross-sectional view illustrating an engine variable valve timing mechanism and an intermediate lock mechanism for one embodiment, made according to the invention.

The invention is hereunder explained in reference to the shown embodiments. First, the constructions of a variable valve timing mechanism (hereinafter referred and abbreviated to as "VTC") and an intermediate lock mechanism 6 are explained in reference to FIG. 1. By the way, these mechanisms are conventional, typical details of such mechanisms being set forth, for example, in Japanese patent provisional publication No. 2007-132272 (A), the teachings of which are hereby incorporated by reference.

The VTC is comprised of an external rotor 1 (a first rotor) adapted to rotate in synchronism with rotation of a crankshaft of an engine and serving as a driving rotary member, an internal rotor (a second rotor) arranged coaxially with the external rotor and configured to be rotatable relatively to the external rotor 1 and serving as a driven rotary member that rotates together with a camshaft for opening and closing valves, and a hydraulically-operated VTC actuator (a first actuator) configured to variably adjust valve timing of an intake/exhaust valve, opened and closed by the camshaft, by changing a relative rotation position (a rotation phase) of one of the two rotors 1, 2 to the other within a movable range between a maximum phase-advance position and a maximum phase-retard position.

Fluid-pressure chambers 40 are formed or defined between the external rotor 1 and the internal rotor 2 as the VTC actuator. Fluid-pressure chambers 40 are partitioned by respective vanes 5 by which the fluid-pressure chamber is partitioned into a phase-retard chamber 42 and a phase-advance chamber 43. When the volumetric capacity of phase-retard chamber 42 increases by supplying engine oil, serving as working fluid, the relative rotation position of the internal rotor 2 to the external rotor 1 is displaced toward the phase-retard side. Conversely when the volumetric capacity of phase-advance chamber 43 increases, the relative rotation position is displaced toward the phase-advance side.

By the way, external rotor 1 is installed outside of the internal rotor in a manner so as to be rotatable relatively to the internal rotor 2 within a predetermined range. A timing sprocket 20 is integrally formed on the outer periphery of external rotor 1. A wrapping power-transmission member, such as a timing belt, is wound on the timing sprocket 20 and a gear attached to the engine crankshaft. When the engine crankshaft is driven and rotated, rotary power is transmitted through the power-transmission member to the timing sprocket 20. Therefore, external rotor 1, equipped with the timing sprocket 20, is driven to rotate along a rotation direction S, and internal rotor 2 is also driven to rotate along the rotation direction S, and the camshaft rotates. Thus, cams, provided on the camshaft, operate to push down intake and exhaust valves of the engine for valve-opening.

Intermediate lock mechanism 6 is provided for restricting the relative rotation position of one of the two rotors 1, 2 to the other at an intermediate lock position suited for starting the engine. The intermediate lock position is positioned midway between the maximum phase-advance position and the maximum phase-retard position. By the way, the engine is provided with a crank angle sensor 78 for detecting a current crank angle and a cam angle sensor 79 for detecting an angular position (a phase) of the camshaft. An ECM (engine control module) 9, serving as an electronic control unit, is configured to detect or derive engine speed NE and a detected value VTCNOW of a relative phase difference (hereinafter referred to as "VTC conversion angle") between the external rotor 1 and the internal rotor 2, corresponding to valve timing of the intake/exhaust valve, from detection results of these sensors. The ECM is also configured to detect and determine, based on the detected value VTCNOW of the VTC conversion angle, whether the VTC conversion angle is a phase-advance side rotation position or a phase-retard side rotation position with respect to the intermediate lock position.

Also, ECM 9 stores and memories a target value VTCTRG of an optimal VTC conversion angle, suited for each engine operating condition, in its memories. The ECM is configured to set a target value VTCTRG of an optimal VTC conversion angle depending on an engine operating condition (engine speed, engine temperature such as engine coolant temperature, engine oil temperature, and the like), detected individually. Therefore, ECM 9 generates and outputs a control command for controlling the VTC conversion angle such that the VTC conversion angle is brought closer to a target value VTCTRG of an optimal VTC conversion angle suited for the current engine operating condition. The ECM 9 is further configured to fetch input information about an ON/OFF state of an engine start-stop switch 81 (see FIG. 3) operated by the driver, engine oil temperature detected by an oil temperature sensor, and the like.

The construction of the hydraulically-operated VTC actuator, which hydraulically drives the VTC, is hereunder explained more concretely. External rotor 1 is formed with a plurality of radially-inward protruding portions 4 spaced apart from each other. The previously-discussed fluid-pressure chamber 40 is defined between the associated two adjacent protruding portions 4. Vane grooves 41 are formed at given positions of the outer periphery of internal rotor 2, facing the respective fluid-pressure chambers 40. A vane 5, which partitions the internal space of fluid-pressure chamber 40 into phase-advance chamber 43 and phase-retard chamber 42 adjacent to each other along the relative-rotation direction, is supported in the vane groove 41 so as to be slidable along the radial direction. Phase-advance chamber 43 communicates with a phase-advance passage 11 formed in the internal rotor 2, whereas phase-retard chamber 42 communicates with a phase-retard passage 10 formed in the internal rotor 2. Phase-retard passage 10 and phase-advance passage 11 are connected to a hydraulic circuit 7 described later.

Fluid-supply to and fluid-discharge from fluid-pressure chamber 40 (phase-advance chamber 43 and phase-retard chamber 42) are accomplished via a spool type OCV (fluid control valve) 76. OCV 76 is configured to control switching of the spool position among a first state W1 where fluid-supply to phase-advance chamber 43 is enabled (permitted) and fluid-discharge from phase-retard chamber 42 is enabled, a second state W2 where fluid-supply to phase-advance chamber 43 is enabled and the phase-retard passage is closed, a third state W3 where the phase-advance passage and the phase-retard passage are both closed and thus fluid-supply to both the phase-advance chamber 43 and the phase-retard chamber 42 is stopped, a fourth state W4 where the phase-advance passage is closed and fluid-supply to phase-retard chamber 42 is enabled, and a fifth state W5 where fluid-discharge from phase-advance chamber 43 is enabled and fluid-supply to phase-retard chamber 42 is enabled. Hence, the quantity of fluid supplied to or discharged from phase-advance chamber 43 and the quantity of fluid discharged from or supplied to phase-retard chamber 42 are both adjustable. Concretely, the position of the spool, which is slidably supported in a housing of OCV 76, can be adjusted in a left-to-right direction of the drawing by means of a linear solenoid (not shown), by controlling the amount of electricity supplied to the linear solenoid incorporated in the OCV 76 by means of the ECM 9.

Fluid-supply to and fluid-discharge from the intermediate lock mechanism 6 are accomplished through the use of an OSV (fluid-flow directional control valve) 77. Hydraulic circuit 7, which also includes the OSV 77, is configured to accomplish fluid-supply to and fluid-discharge from the intermediate lock mechanism 6, separately from fluid-supply to and fluid-discharge from phase-advance chamber 43 and fluid-discharge from and fluid-supply to phase-retard chamber 42. That is, the hydraulic circuit functions as a hydraulically-operated intermediate lock actuator (a second actuator) configured to lock to or unlock from the intermediate lock position by driving each of lock pieces 60A, 60B in a direction for moving the lock pieces toward a lock recessed portion 62 or in a direction for moving the lock pieces apart from the lock recessed portion. By the way, as described later, engagement of lock pieces 60A, 60B into the lock recessed portion 62 is accomplished by the OSV 77, independently of hydraulic control for hydraulic pressure in the phase-advance hydraulic-pressure path and hydraulic pressure in the phase-retard hydraulic-pressure path. Hence, lock pieces 60A, 60B can be surely easily brought into engagement with the lock recessed portion 62 even in a state where the hydraulic pressure becomes unstable immediately after the engine has been stopped.

Hydraulic circuit 7 changes the position of vane 5 in the fluid-pressure chamber 40 by executing supply of engine oil, serving as working fluid, to one of phase-advance chamber 43 and phase-retard chamber 42 through phase-advance passage 11 or phase-retard passage 10 or by executing both engine-oil supply to the one chamber and engine-oil discharge from the other chamber. That is, the hydraulic circuit functions as the hydraulically-operated VTC actuator configured to displace and adjust the relative rotation position of the internal rotor 2 to the external rotor 1 between the maximum phase-advance position (i.e., the relative rotation position at which the volumetric capacity of phase-advance chamber 43 becomes a maximum) and the maximum phase-retard position (i.e., the relative rotation position at which the volumetric capacity of phase-retard chamber 42 becomes a maximum), and whereby valve timing of the intake/exhaust valve, opened and closed by the camshaft, is varied.

Concretely, hydraulic circuit 7 is provided with a pump 70, which is driven by a driving force of the engine for supplying engine oil, serving as working fluid and/or lock oil (described later) to OCV 76 and/or OSV 77. An operative/inoperative state of pump 70 is controlled responsively to a control command from the ECM 9. OCV 76 is located downstream of the pump 70 of hydraulic circuit 7 and also located upstream of phase-advance chambers 43 and phase-retard chambers 42. On the other hand, OSV 77 is located downstream of the pump 70 and also located upstream of a lock oil passage 63 configured to communicate with the lock recessed portion 62. Pump 70 is connected to an oil pan 75, in which engine oil is stored. In the hydraulic circuit 7, phase-advance passage 11 and phase-retard passage 10 are connected to respective specified ports of OCV 76, whereas lock oil passage 63 is connected to a specified port of OSV 77.

Intermediate lock mechanism 6 is comprised of a phase-retard lock portion 6A and a phase-advance lock portion 6B, both installed on the external rotor 1, and the lock recessed portion 62 formed in a part of an outermost peripheral surface 2A of internal rotor 2. Phase-retard lock portion 6A has the lock piece 60A supported on the external rotor 1 so as to be slidable in the radial direction, and a spring 61 for biasing the lock piece 60A radially inward. Phase-advance lock portion 6B has the lock piece 60B supported on the external rotor so as to be slidable in the radial direction, and a spring 61 for biasing the lock piece 60B radially inward. Lock recessed portion 62 is not configured as a conventional circumferentially-elongated single-step groove, which extends along the circumferential direction of internal rotor 2 and into which lock pieces 60A, 60B are engageably inserted. As seen in FIG. 1, the lock recessed portion 62 is configured as a two-step ratchet groove having an engaged groove 62M, which performs an original lock function, and auxiliary engaged grooves 62*a*, 62*b* each having a shallower depth of engagement with lock pieces 60A, 60B than the engaged groove 62M. Auxiliary engaged groove 62*a* is configured to extend toward the phase-advance side from a circumferential end on the maximum phase-advance side of engaged groove 62M. Auxiliary engaged groove 62*b* is configured to extend toward the phase-retard side from a circumferential end on the maximum phase-retard side of engaged groove 62M. Each of the auxiliary engaged grooves has a slight circumferential length. The bottom face of engaged groove 62M and the bottom face of each of auxiliary engaged grooves 62*a*, 62*b*, with which the tips of lock pieces 60A, 60B are brought into abutted-engagement, are configured to extend parallel to the outermost peripheral surface 2A of internal rotor 2. For instance, a plate shape, a pin shape, and the like can be appropriately adopted as a shape of each of lock pieces 60A, 60B.

Phase-retard lock portion 6A prevents the internal rotor 2 from rotating relatively to the external rotor 1 from the intermediate lock position toward the phase-retard side (in the direction indicated by the arrow S1 in FIG. 1) by bringing the phase-retard lock piece 60A into engagement with the lock recessed portion 62 (engaged groove 62M or auxiliary engaged groove 62*a*). On the other hand, phase-advance lock portion 6B prevents the internal rotor 2 from rotating relatively to the external rotor 1 from the intermediate lock position toward the phase-advance side (in the direction indicated by the arrow S2 in FIG. 1) by bringing the phase-advance lock piece 60B into engagement with the lock recessed portion 62 (engaged groove 62M or auxiliary engaged groove 62*b*). That is, in a state where either the phase-retard lock portion 6A or the phase-advance lock portion 6B has been brought into engagement with the lock recessed portion 62, the rotation position change to one of the phase-retard side and the phase-advance side is restricted, while the rotation position change to the other is permitted.

Of these engaged grooves, all included in the lock recessed groove 62, the width of engaged groove 62M, which depth is deeper than the auxiliary engaged grooves 62*a*, 62*b*, is dimensioned to be substantially conformable to the distance between side faces of phase-retard lock piece 60A and phase-advance lock piece 60B, facing apart from each other in the circumferential direction of internal rotor 2. Therefore, the relative rotation positions of both of the rotors 1, 2 can be restricted essentially at the intermediate lock position without any width deviated from the intermediate lock position by simultaneously bringing both of phase-retard lock piece 60A and phase-advance lock piece 60B into engagement with the engaged groove 62M, and thus the relative rotation positions can be held in a so-called lock state. Auxiliary engaged grooves 62*a*, 62*b*, each having a shallower depth of engagement with lock pieces 60 than the engaged groove 62M, serve to hold the relative rotation positions of both of the rotors 1, 2 within a range closer to the intermediate lock position by bringing the lock pieces 60A, 60B, which are not engageably inserted into the engaged groove 62M, into engagement with the respective auxiliary engaged grooves 62*a*, 62*b*, instead of holding the relative rotation positions in the lock state.

By the way, lock recessed portion 62 communicates with the lock oil passage 63 formed in the internal rotor 2. Lock oil passage 63 is connected to the specified port of OSV 77 of hydraulic circuit 7. Thus, hydraulic circuit 7 is configured to enable supply of engine oil, serving as lock oil, to the lock recessed portion 62 and engine-oil discharge from the lock recessed portion 62 via the lock oil passage 63. When lock oil is supplied from the OSV 77 to the lock recessed portion 62, a pair of lock pieces 60A, 60B, which has been engageably inserted into the lock recessed portion 62, is drawn into the external rotor 1 until the tips of lock pieces 60A, 60B are displaced and positioned slightly outward of the outermost peripheral surface 2A of internal rotor 2 in the radial direction. As a result, the lock state (the interlocking state) of both of the rotors 1, 2 is released, thereby enabling relative rotation.

Figure 2:
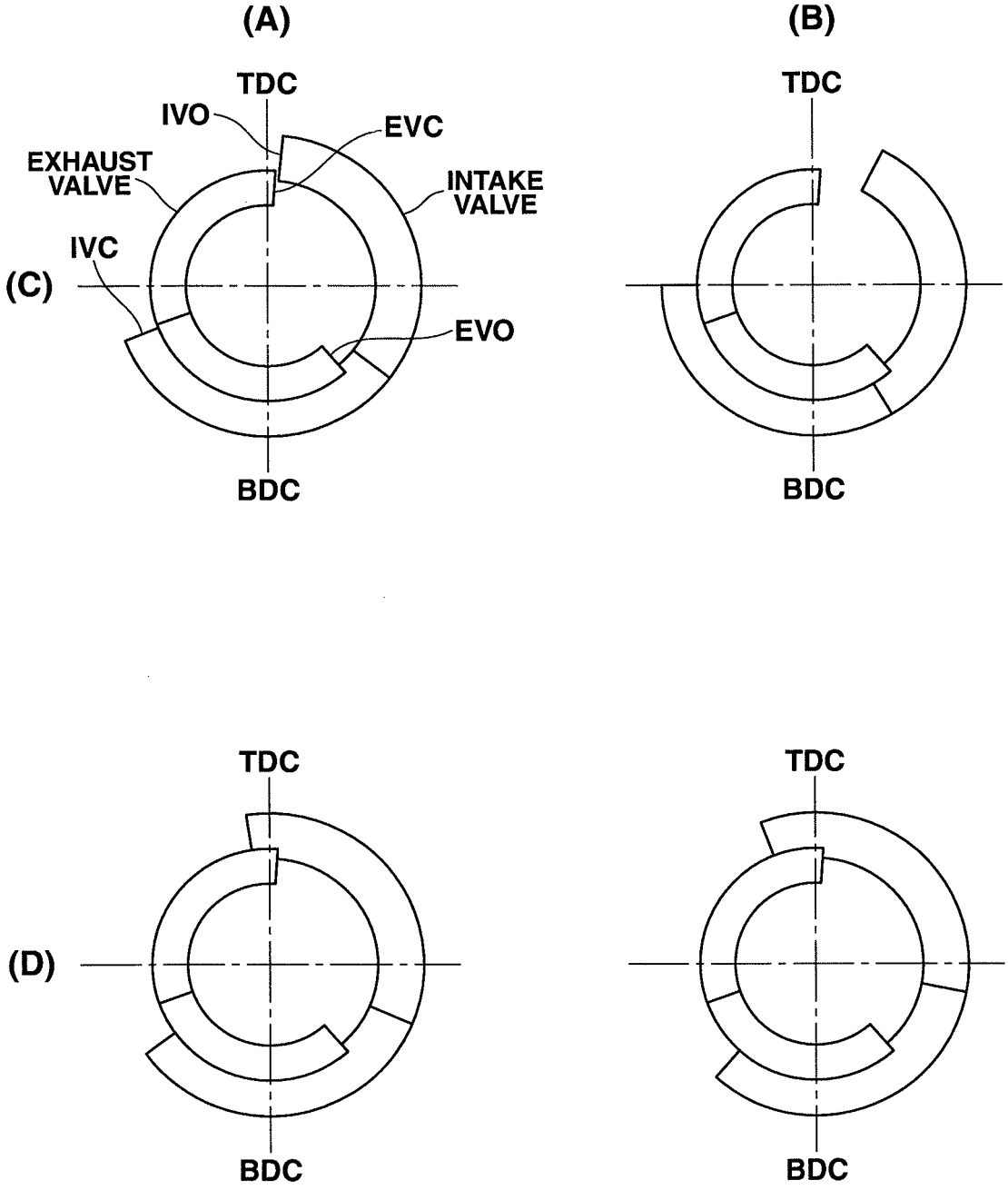
FIG. 2 is an explanatory view illustrating valve timings of intake and exhaust valves, the column (A) showing valve timings in an engine vehicle that uses an engine as a driving power source, the column (B) showing valve timings in a hybrid vehicle that uses both an engine and a motor as a vehicle driving power source, the row (C) showing valve timings at an initial position, and the row (D) showing valve timings at an intermediate lock position.

Referring to FIG. 2, there is shown valve timings of intake and exhaust valves in the case that the VTC is applied to the intake-valve side and valve timing of the exhaust-valve side is fixed. In this figure, the column (A) exemplifies valve timings in a general engine vehicle that uses an engine as a vehicle driving power source. The column (B) exemplifies valve timings in a hybrid vehicle that uses both an engine and a motor generator as a vehicle driving power source. Also, the row (C) shows valve timings at a maximum phase-retard position corresponding to an initial position. The row (D) shows valve timings at an intermediate lock position suited for starting the engine.

As seen in this figure, regarding both of the engine vehicle and the hybrid vehicle, valve timings at the initial position are different from valve timings at the intermediate lock position suited for starting the engine. In each of the engine vehicle and the hybrid vehicle, valve timings at the intermediate lock position are phase-advanced with respect to valve timings at the initial position. In particular, in the hybrid vehicle, for the purpose of improved fuel economy and reduced hydrocarbons (HCs) by virtue of Miller-cycle decompression effects, a variable width of valve timing is set greater than that of the engine vehicle, and thus the valve-timing phase-advance quantity from the initial position to the intermediate lock position is larger.

For instance, assuming that the relative rotation positions of both of the rotors are not yet restricted at the intermediate lock position when the engine is stopped, generally, the relative rotation positions of both of the rotors 1, 2 tend to be returned to the initial position owing to a reaction of the valve operating system during stopping of the engine. Thus, during next engine starting, the relative rotation positions of both of the rotors 1, 2 have to be moved from the initial position to the intermediate lock position suited for starting the engine by driving the VTC. However, when the engine is started, the hydraulic pressure is still low, and thus it is difficult to move the relative rotation positions from the initial position to the intermediate lock position suited for starting the engine by driving the hydraulically-operated VTC. As a result, it takes time for starting up the engine, thereby deteriorating the engine startability. Therefore, in the embodiment, as described later, when an engine stop request is detected, the VTC and the intermediate lock mechanism 6 are driven and controlled before an engine stopping process is initiated so as to hold the relative rotation positions in the intermediate lock state where the relative rotation positions of both of the rotors 1, 2 are restricted at the intermediate lock position, thereby enhancing the startability during next engine starting.

Figure 3:
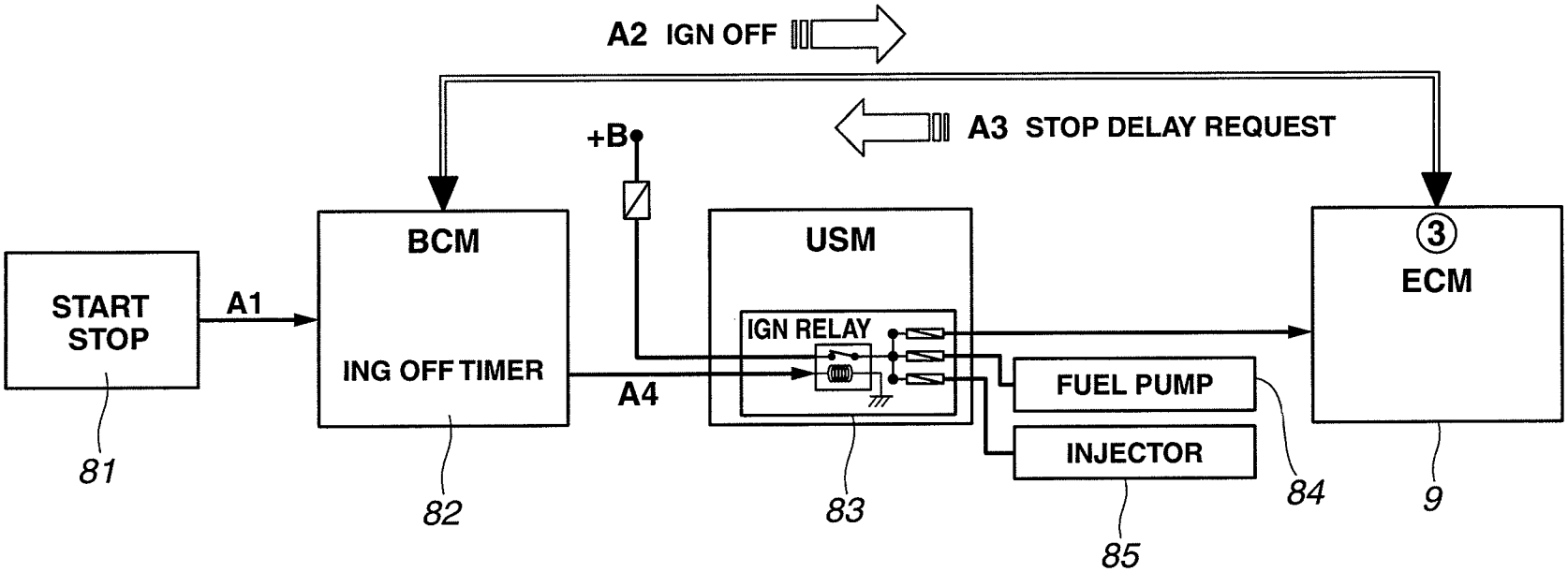
FIG. 3 is an explanatory view illustrating one example of a vehicle control system.

Referring to FIG. 3, there is exemplified the vehicle control system to which the aforementioned valve timing control apparatus is applied. In addition to the above-discussed ECM 9 for controlling the engine, the vehicle control system has a plurality of electronic control units such as a BCM (a body control module) 82 and the like for controlling various on-vehicle electrical component parts, and the electronic control units are connected to each other by CAN (controller area network) communication so that these electronic control units can be mutually communicated. BCM 82 is connected to the engine start-stop switch 81 operated by the driver, so as to receive an engine start request or an engine stop request from the engine start-stop switch. When the engine is stopped, an ignition relay 83 is turned OFF responsively to an engine stop signal (IGN OFF) from the BCM 82, and then an engine stopping process, such as stopping of the driving of a fuel pump 84, stopping of fuel injection by an injector 85, and the like, is executed.

Figure 4:
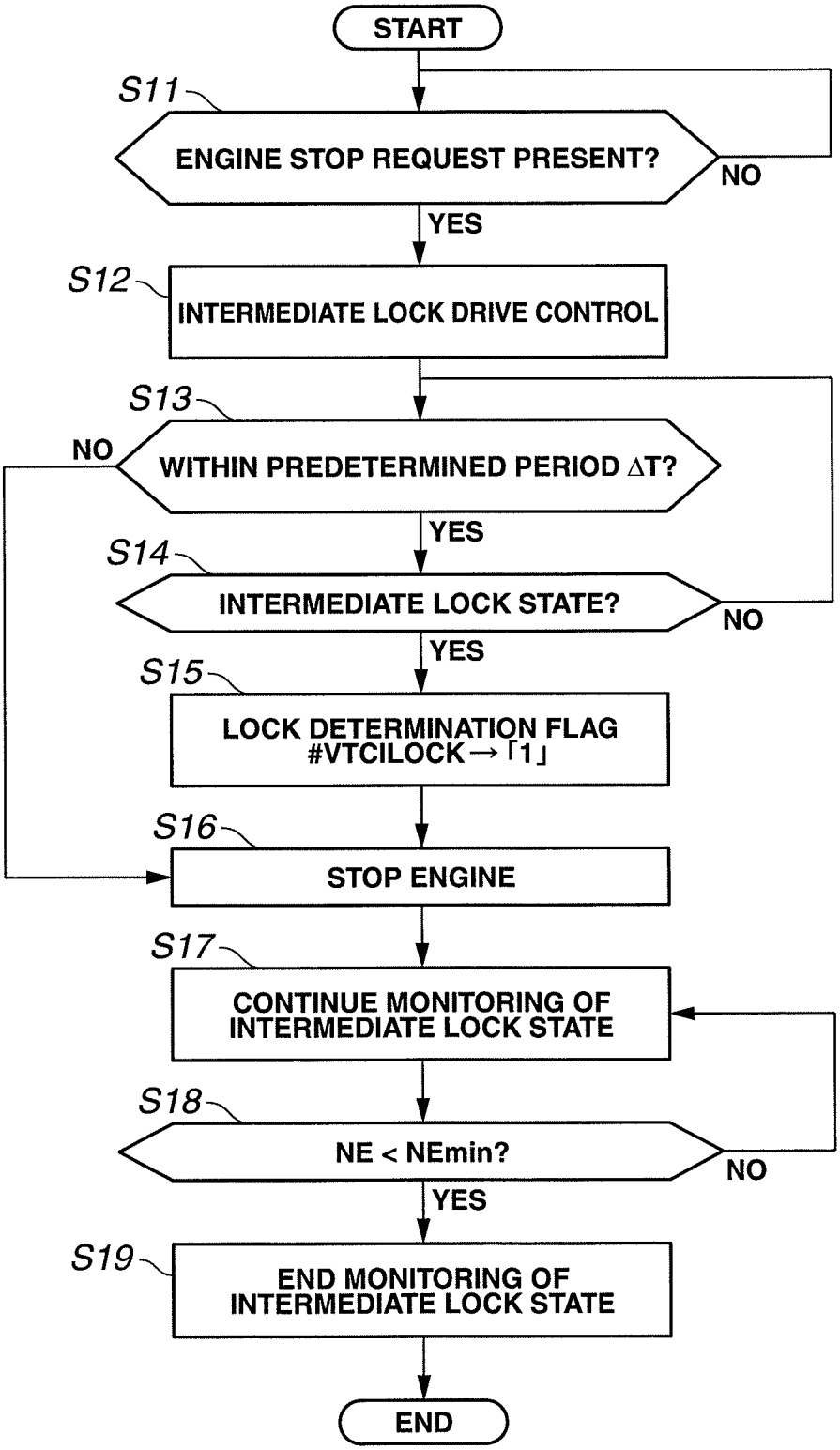
FIG. 4 is a flowchart illustrating a control flow of the embodiment.

Referring to FIG. 4, there is shown the flowchart illustrating the control flow of the embodiment. At step S11, a check is made to determine whether an engine stop request is detected during engine running. For instance, such an engine stop request is detected by operating the engine start-stop switch 81 to its OFF state. In the case of a vehicle having an engine automatic stop function, such an engine stop request is detected in the presence of an engine automatic stop request.

When the engine stop request is detected, the routine proceeds to step S12. To establish the intermediate lock state suited for next engine starting, the VTC and the intermediate lock mechanism 6 are driven and controlled. Concretely, the relative rotation positions of both of the rotors 1, 2 are driven and controlled closer to the intermediate lock position, and at the same time the lock pieces 60A, 60B of intermediate lock mechanism 6 are driven and controlled in a manner so as to be brought into engagement with the lock recessed portion 62.

Figure 5:
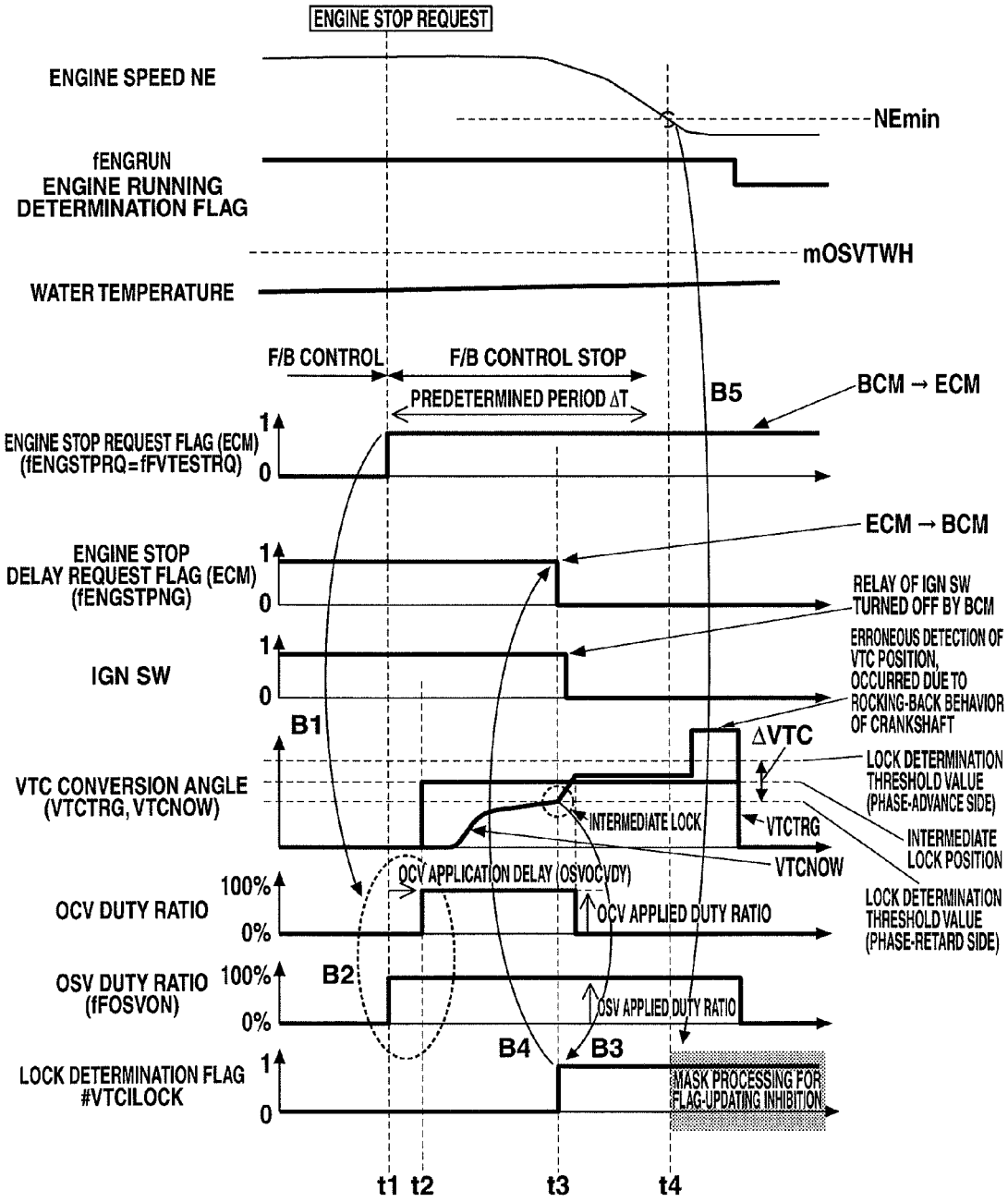
FIG. 5 is a timing chart illustrating one example of a control action of the embodiment, executed when the vehicle is stopped.

At the subsequent step S13, as seen in FIG. 5, a check is made to determine whether the time, elapsed from a point of time (t1) when the engine stop request is detected, is within a predetermined period ΔT (for example, about one second). At step S14, a check is made to detect, based on the detected value VTCNOW of the VTC conversion angle, corresponding to the valve timing, whether the intermediate lock state is established (intermediate lock detection means). Concretely, as seen in FIG. 5, when the detected value VTCNOW of the VTC conversion angle is within the predetermined range ΔVTC whose center is the intermediate lock position, it is detected and confirmed that the intermediate lock state is established. As discussed previously, the detected value VTCNOW is calculated based on detected signals from the crank angle sensor 78 and the cam angle sensor 79.

When the intermediate lock state is detected within the predetermined period ΔT from detection of the engine stop request, the answer to each of steps S13, S14 is in the affirmative, and thus the routine proceeds to step S15. At step S15, as seen in FIG. 5, a lock determination flag #VTC|LOCK is set to "1" representing that the intermediate lock state is established. Then, at step S16, an engine stopping process such as fuel-injection stopping is initiated (engine stop means). That is, immediately when the intermediate lock state is detected within the predetermined period ΔT from detection of the engine stop request, the engine stopping process is promptly initiated.

Conversely when the predetermined period ΔT from detection of the engine stop request has expired without detecting and confirming that the intermediate lock state is established within the predetermined period, the answer to step S13 is in the negative, and thus the routine proceeds to step S16. At step S16, the engine stopping process is executed without waiting for the detection and confirmation of the intermediate lock state. In this manner, immediately when the predetermined period ΔT from detection of the engine stop request has expired, the engine stopping process is forcibly initiated, and hence it is possible to avoid an excessive delay in actually initiating the engine stopping process from the point of time of the engine stop request, and whereby the engine can be stopped with a high responsiveness without causing the driver to feel discomfort.

Immediately when the engine stopping process is initiated, the routine proceeds from step S16 to step S17. At step S17, monitoring of the intermediate lock state is continued (intermediate lock monitoring continuation means). That is, in a similar manner to steps S14 and S15, step S17 detects, based on the detected value VTCNOW of the VTC conversion angle, whether the intermediate lock state is established. When the intermediate lock state is detected, a lock determination flag #VTC|LOCK is set to "1" representing that the intermediate lock state is established. In this manner, even after the engine stopping process has been initiated, confirming-and-monitoring of the intermediate lock state is continued, and whereby even in the case that the intermediate lock state becomes established with the engine crankshaft rotating by inertia after the engine stopping process has been initiated, this kind of intermediate lock state can be detected. Hence, it is possible to more certainly detect the intermediate lock state.

While the engine speed NE is reducing after the engine stopping process has been initiated, a so-called "rocking-back behavior" of the crankshaft, in which the direction of rotation of the crankshaft is repeatedly reversed between the normal-rotational direction and the reverse-rotational direction owing to a reaction of each engine cylinder on the compression stroke, tends to occur just before the engine speed NE reduces to zero and the engine stops. In such a situation, the detected value VTCNOW of the VTC conversion angle tends to become inaccurate, and hence there is a possibility of an erroneous determination in detecting the intermediate lock state.

To avoid such an erroneous determination, at step S18, a check is made to determine whether the engine speed NE becomes less than a predetermined value NEmin (for example, approximately 300 rpm). When the engine speed NE becomes less than the predetermined value NEmin, the routine proceeds to step S19. At step S19, monitoring of the intermediate lock state terminates.

The confirmed and monitored contents (information) on whether the rotation phase is in the intermediate lock state or out of the intermediate lock state are stored and held as the lock determination flag #VTC|LOCK, in preparation for next engine starting. During next engine starting, a check is made to determine, based on the lock determination flag #VTC|LOCK, whether the intermediate lock state is established. When the intermediate lock state has been established, an engine starting process, such as cranking via a starter, is promptly initiated without driving the VTC and the intermediate lock mechanism 6. Conversely when the intermediate lock state has not yet been established, in order to secure the engine starting stability, at least the VTC is driven before the engine starting process is initiated, so as to change the VTC conversion angle to the intermediate lock position suited for starting the engine. It is more preferable to initiate the engine starting process, under a state where the rotation phase is held at the intermediate lock state by means of the intermediate lock mechanism 6.

Assume that the contents on whether the rotation phase is in the intermediate lock state or out of the intermediate lock state are not stored. In such a case, during execution of fuel-injection control when starting the engine, each and every VTC conversion angle has to be supposed, until such time that a normal reference position of the VTC conversion angle has been detected. In contrast to the above, as previously discussed by reference to the embodiment, assume that the contents on whether the rotation phase is in the intermediate lock state or out of the intermediate lock state are stored. When the intermediate lock state has already been established, it is possible to execute high-precision fuel-injection control without waiting for the detection of a normal reference position.

Referring to FIG. 5, there is shown the timing chart illustrating one example of a control action of the embodiment, executed when the engine is stopped. The control action of the embodiment when the engine is stopped is hereunder described in more detail, in reference to FIGS. 5 and 3.

When BCM 82 detects an engine stop request from the engine start-stop switch 81 operated by the driver during engine running (see the arrow A1 in FIG. 3), the BCM 82 sends an engine stop preliminary-notice signal (IGN OFF) to the ECM 9 for stopping the engine (see the arrow A2 in FIG. 3).

As shown in FIG. 5, the ECM 9, which has received the preliminary-notice signal, stops air/fuel (A/F) mixture ratio feedback control (F/B control) for a fuel injection amount, for injecting and supplying a very small amount of fuel that permits self-sustaining, and set an engine stop request flag fENGSTPRQ to "1" representing that an engine stop request is present, and initiates drive control to the intermediate lock state. Concretely, as indicated by the arrow B1 and the area B2 in FIG. 5, the duty ratio of a command signal to the OSV 77 of the intermediate lock actuator is set to 100% so as to drive the lock pieces 60A, 60B in a direction that the lock pieces are brought into engagement with the lock recessed portion 62. At the point of time t2 when a predetermined OCV application delay time period (OSVOCVDY), preset as a delay time period for ensuring a rise in hydraulic pressure for the OSV 77, has expired, the target value VTCTRG of the VTC conversion angle, corresponding to the valve timing of the VTC, is set to the intermediate lock position. When the detected value VTCNOW exists on the phase-retard side (see FIG. 5) with respect to the target value VTCTRG owing to such a change in the target value, the duty ratio of a command signal to the OCV 76 of the VTC actuator is set to 100% toward the side opposite to the phase-retard side, so as to drive or shift the VTC conversion angle toward the phase-advance side with a maximum output power, thus enabling a displacement to the intermediate lock position. In this manner, it is determined whether the detected value VTCNOW exists on the phase-advance side or the phase-retard side with respect to the target value VTCTRG corresponding to the intermediate lock position, and then the VTC is driven in the opposite direction, that is, toward the intermediate lock position with a maximum output power. Hence, it is possible to shorten a time length from the time when the engine stop request has been received to the time when the intermediate lock state has been established.

Additionally, in establishing the intermediate lock state, the predetermined delay time period (OSVOCVDY) is provided during a time period from the starting point (t1) of the operation of the intermediate lock actuator with the OSV 77 energized to the starting point (t2) of the operation of the VTC actuator with the OCV 76 energized, in a manner so as to build up hydraulic pressure for the intermediate lock actuator in advance before the starting point (t2) of the operation of the VTC. Hence, when the VTC conversion angle is shifting to the intermediate lock position by means of the VTC actuator, it is possible to establish the intermediate lock state by more certainly operating the intermediate lock mechanism, thereby suppressing the occurrence of malfunction of the lock mechanism.

Figure 6:
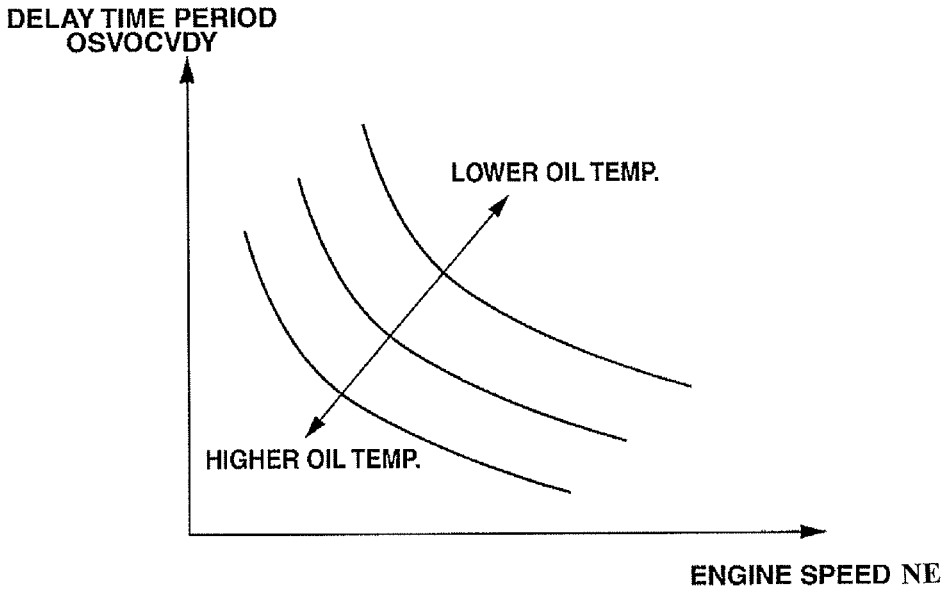
FIG. 6 is a characteristic diagram showing the relationship among engine speed, oil temperature, and delay time.

The above-mentioned delay time period (OSVOCVDY) is set, based on engine speed NE and oil temperature (or water temperature) serving as engine temperature, by reference to a predetermined map shown in FIG. 6. As seen in FIG. 6, as the engine speed NE increases, the driving force of pump 70 increases and a buildup in hydraulic pressure becomes quick, and hence the delay time period (OSVOCVDY) has to be shortened. Furthermore, as the engine temperature, such as oil temperature and the like, rises, a viscosity of engine oil decreases and a buildup in hydraulic pressure becomes quick, and hence the delay time period (OSVOCVDY) has to be shortened. As discussed above, it is possible to appropriately set the delay time period depending on engine speed and engine temperature.

By the way, setting of the delay time period (OSVOCVDY) is not limited to the particular setting shown and described herein. For instance, hydraulic pressure is detected or estimated and then the delay time period may be set, based on the detected or estimated hydraulic pressure, by reference to a predetermined table. In lieu thereof, simply, a fixed value may be used as the delay time period.

Additionally, ECM 9 is configured to detect and monitor the intermediate lock state on condition that the engine temperature is less than or equal to a predetermined threshold value mOSVTWH (for example, approximately 60° C.) after the point of time t1 when the engine stop request has been detected. Under this condition, the ECM is configured to detect and monitor, based on the detected value VTCNOW corresponding to the current value of the VTC conversion angle, whether the intermediate lock state is established, for instance every operation time intervals. When the current value VTCNOW of the VTC conversion angle is within the predetermined range ΔVTC whose center is the intermediate lock position and which extends between a phase-advance side lock determination threshold value and a phase-retard side lock determination threshold value within a predetermined period ΔT from the point of time t1 when the engine stop request is detected, and the OSV 77 is in its energized state (at a duty ratio of 100%), that is, lock pieces 60A, 60B are driven to the lock recessed portion 62, at that point t3, the ECM determines that the rotation phase is in the intermediate lock state where lock pieces 60A, 60B have been brought into engagement with the lock recessed portion 62. Thereafter, the duty ratio of the OCV 76 is set to "0", and thus the drive control of the VTC to the intermediate lock position terminates. Additionally, the lock determination flag #VTC|LOCK is set to "1" representing that the intermediate lock state is established, and simultaneously an engine stop delay request flag fENGSTPNG to "0" representing that a delay in stopping the engine is unnecessary and thus the engine stopping process is executable. Information about the 1-0 settings of these flags is sent to the BCM 82 (see the arrow A3 in FIG. 3 and the arrow B3 in FIG. 5). Responsively to this input information, BCM 82 sets a command of an ignition switch IGN SW to "0" (see the arrow A4 in FIG. 3), and thus the ignition relay becomes turned OFF, so as to initiate the engine stopping process.

By the way, even after the time t3 at which the intermediate lock state has been detected, the duty ratio of the OSV 77 is retained unchanged and thus maintained at 100%. That is, the operative state of the intermediate lock mechanism 6 is continued. This is because it is detected that the intermediate lock state is established when the current value VTCNOW of the VTC conversion angle is within the predetermined range ΔVTC, which range allows for the area of auxiliary engaged grooves 62*a*, 62*b*, but actually a detection error exists and hence lock pieces 60A, 60B may be brought into engagement with the shallower auxiliary engaged grooves 62*a*, 62*b* formed on both sides of the engaged groove 62M without moving into engagement with the deeper engaged groove 62M of lock recessed portion 62, or the lock pieces may be positioned near the lock recessed portion 62 without moving into engagement with the lock recessed portion. Even in such a situation, in many cases, by virtue of vibrations of the engine the rotation phase can reach the intermediate lock state where lock pieces 60A, 60B have been brought into engagement with the lock recessed portion 62. However, in the shown embodiment, in order to more certainly confirm that the intermediate lock state has been established, even after the time t3 at which the intermediate lock state has been detected once, the operative state of the intermediate lock mechanism 6 is continued and monitoring of the intermediate lock state is continued, until such time that the engine has substantially stopped running.

Thereafter, at the point of time t4 at which the engine speed NE has been reduced to below a predetermined value NEmin (for example, approximately 300 rpm), as indicated by the arrow B5 in FIG. 5, monitoring of the intermediate lock state terminates by executing mask processing, which inhibits updating of the lock determination flag #VTCILOCK. By virtue of the mask processing, even in the case that the engine speed decreases approximately zero and then an erroneous detection of the current value VTCNOW of the VTC conversion angle has occurred due to "oscillations and rocking-back behavior" of the crankshaft, in which the direction of rotation of the crankshaft is repeatedly reversed between the normal-rotational direction and the reverse-rotational direction owing to a reaction of each engine cylinder on the compression stroke, it is possible to certainly avoid an erroneous determination of the intermediate lock state, which may occur as a result of the erroneous detection.

Thereafter, immediately when it is confirmed that the crankshaft has stably stopped rotating and thus the engine has stopped running, an engine running determination flag fENGRUN is set to "0" representing that the engine has stopped running. At the same time, the duty ratio of the OSV 77 is set to "0" so as to stop the operation of the intermediate lock mechanism 6.

While the foregoing is a description of the preferred embodiments carried out the invention, it will be understood that the invention is not limited to the particular embodiments shown and described herein, but that various changes and modifications may be made without departing from the scope or spirit of this invention. For instance, in the previously-discussed embodiment, the variable valve timing mechanism is installed on the intake-valve side. In lieu thereof, the inventive concept may be applied to a variable valve timing mechanism installed on the exhaust-valve side. Also, in the previously-discussed embodiment, after the normal engine stopping process normally executed when the intermediate lock state has been detected within a predetermined period as well as after the forcible engine stopping process forcibly executed when the predetermined period from detection of the engine stop request has expired without detecting the intermediate lock state within the predetermined period, monitoring of the intermediate lock state is continued. Not only this, the control system may be configured so that monitoring of the intermediate lock state is continued only after the forcible engine stopping process and that monitoring of the intermediate lock state is not continued after the normal engine stopping process.

The invention claimed is:

1. An engine valve timing control apparatus, comprising:

a variable valve timing mechanism having a first rotor adapted to rotate in synchronism with rotation of a crankshaft of an engine and a second rotor adapted to rotate together with a camshaft of the engine and configured to be rotatable relatively to the first rotor, the variable valve timing mechanism being configured to variably adjust valve timing of an intake/exhaust valve, opened and closed by the camshaft, by changing relative rotation positions of both of the rotors within a movable range between a maximum phase-advance position and a maximum phase-retard position;

an intermediate lock mechanism configured to restrict the relative rotation positions of both of the rotors at an intermediate lock position suited for starting the engine and positioned midway between the maximum phase-advance position and the maximum phase-retard position;

the variable valve timing mechanism and the intermediate lock mechanism being driven and controlled so as to establish an intermediate lock state where the relative rotation positions are restricted at the intermediate lock position, when an engine stop request is detected;

an intermediate lock detection means for detecting whether the intermediate lock state has been established;

an engine stop means for executing an engine stopping process when a predetermined period from detection of the engine stop request has expired without detecting the intermediate lock state within the predetermined period; and an intermediate lock monitoring continuation means for continuing monitoring of the intermediate lock state, even after the engine stopping process has been executed.

2. The engine valve timing control apparatus as recited in claim 1, wherein:

the engine stop means includes a means for executing the engine stopping process when the intermediate lock state has been detected within the predetermined period; and the intermediate lock monitoring continuation means continues the monitoring of the intermediate lock state even after the engine stopping process initiated upon detection of the intermediate lock state within the predetermined period.

3. The engine valve timing control apparatus as recited in claim 1, wherein:

the monitoring of the intermediate lock state terminates, when an engine speed reduces to below a predetermined value after execution of the engine stopping process.

4. The engine valve timing control apparatus as recited in claim 3, wherein:

the variable valve timing mechanism and the intermediate lock mechanism are driven and controlled so as to establish the intermediate lock state during next engine starting, when the engine has been stopped in a relative-phase's state remaining out of the intermediate lock state.

5. The engine valve timing control apparatus as recited in claim 1, wherein:

the intermediate lock mechanism is configured to restrict the relative rotation positions of both of the rotors at the intermediate lock position by bringing lock pieces attached to one of the rotors into engagement with an engaged groove formed in the other of the rotors;

auxiliary engaged grooves, each having a shallower depth of engagement with the lock pieces than the engaged groove, are formed in the other rotor, one of the auxiliary engaged grooves being configured to extend toward a phase-advance side from a circumferential end on a maximum phase-advance side of the engaged groove, and the other of the auxiliary engaged grooves being configured to extend toward a phase-retard side from a circumferential end on a maximum phase-retard side of the engaged groove; and the intermediate lock detection means determines that the intermediate lock state is established, when a current value of a relative phase difference between the rotors is within a predetermined angular range, corresponding to circumferential lengths of the auxiliary engaged grooves, a center of the redetermined angular range being configured to be conformable to the intermediate lock position.

6. The engine valve timing control apparatus as recited in claim 1, which further comprises:

a first actuator configured to drive the variable valve timing mechanism by fluid pressure; and a second actuator configured to drive the intermediate lock mechanism by fluid pressure, wherein, when establishing the intermediate lock state, a predetermined delay time period is provided between a point of time when the second actuator begins to drive the intermediate lock mechanism and a point of time when the first actuator begins to drive the variable valve timing mechanism.

7. The engine valve timing control apparatus as recited in claim 6, wherein:

the predetermined delay time period is set, based on an engine temperature and engine speed, by reference to a predetermined map.

8. The engine valve timing control apparatus as recited in claim 1, wherein:

the variable valve timing mechanism is driven toward the intermediate lock position with a maximum output power, when the engine is stopped.

9. The engine valve timing control apparatus as recited in claim 1, wherein:

a result of determination on whether the intermediate lock state is established or not is stored; and a determination on whether drive control should be executed is made based on the stored result of determination during next engine starting.

10. An engine valve timing control apparatus, comprising:

a variable valve timing mechanism having a first rotor adapted to rotate in synchronism with rotation of a crankshaft of an engine and a second rotor adapted to rotate together with a camshaft of the engine and configured to be rotatable relatively to the first rotor, the variable valve timing mechanism being configured to variably adjust valve timing of an intake/exhaust valve, opened and closed by the camshaft, by changing relative rotation positions of both of the rotors within a movable range between a maximum phase-advance position and a maximum phase-retard position;

an intermediate lock mechanism configured to restrict the relative rotation positions of both of the rotors at an intermediate lock position suited for starting the engine and positioned midway between the maximum phase-advance position and the maximum phase-retard position;

the variable valve timing mechanism and the intermediate lock mechanism being driven and controlled so as to establish an intermediate lock state where the relative rotation positions are restricted at the intermediate lock position, when an engine stop request is detected;

an intermediate lock detection section configured to detect whether the intermediate lock state has been established;

an engine stop section configured to execute an engine stopping process when a predetermined period from detection of the engine stop request has expired without detecting the intermediate lock state within the predetermined period; and an intermediate lock monitoring continuation section configured to continue monitoring of the intermediate lock state, even after the engine stopping process has been executed.

11. The engine valve timing control apparatus as recited in claim 10, wherein:

the engine stop section includes a circuit configured to execute the engine stopping process when the intermediate lock state has been detected within the predetermined period; and the intermediate lock monitoring continuation section continues the monitoring of the intermediate lock state even after the engine stopping process initiated upon detection of the intermediate lock state within the predetermined period.

12. The engine valve timing control apparatus as recited in claim 10, wherein:

the monitoring of the intermediate lock state terminates, when an engine speed reduces to below a predetermined value after execution of the engine stopping process.

13. The engine valve timing control apparatus as recited in claim 12, wherein:

the variable valve timing mechanism and the intermediate lock mechanism are driven and controlled so as to establish the intermediate lock state during next engine starting, when the engine has been stopped in a relative-phase's state remaining out of the intermediate lock state.

14. The engine valve timing control apparatus as recited in claim 10, wherein:

the intermediate lock mechanism is configured to restrict the relative rotation positions of both of the rotors at the intermediate lock position by bringing lock pieces attached to one of the rotors into engagement with an engaged groove formed in the other of the rotors;

auxiliary engaged grooves, each having a shallower depth of engagement with the lock pieces than the engaged groove, are formed in the other rotor, one of the auxiliary engaged grooves being configured to extend toward a phase-advance side from a circumferential end on a maximum phase-advance side of the engaged groove, and the other of the auxiliary engaged grooves being configured to extend toward a phase-retard side from a circumferential end on a maximum phase-retard side of the engaged groove; and the intermediate lock detection section determines that the intermediate lock state is established, when a current value of a relative phase difference between the rotors is within a predetermined angular range, corresponding to circumferential lengths of the auxiliary engaged grooves, a center of the predetermined angular range being configured to be conformable to the intermediate lock position.

15. The engine valve timing control apparatus as recited in claim 10, which further comprises:

a first actuator configured to drive the variable valve timing mechanism by fluid pressure; and a second actuator configured to drive the intermediate lock mechanism by fluid pressure, wherein, when establishing the intermediate lock state, a predetermined delay time period is provided between a point of time when the second actuator begins to drive the intermediate lock mechanism and a point of time when the first actuator begins to drive the variable valve timing mechanism.

16. The engine valve timing control apparatus as recited in claim 15, wherein:

the predetermined delay time period is set, based on an engine temperature and engine speed, by reference to a predetermined map.

17. The engine valve timing control apparatus as recited in claim 10, wherein:

the variable valve timing mechanism is driven toward the intermediate lock position with a maximum output power, when the engine is stopped.

18. The engine valve timing control apparatus as recited in claim 10, wherein:

a result of determination on whether the intermediate lock state is established or not is stored; and a determination on whether drive control should be executed is made based on the stored result of determination during next engine starting.

* * * * *